United States Patent [19]

Poyser

[11] 4,018,648

[45] Apr. 19, 1977

[54] GALVANIC PROTECTION OF A COUCH ROLL

[75] Inventor: Harold E. Poyser, Hot Springs, Va.

[73] Assignee: Westvaco Corporation, New York, N.Y.

[22] Filed: Mar. 25, 1976

[21] Appl. No.: 670,181

[52] U.S. Cl. ..... 162/199; 162/272; 162/369; 162/372; 204/148; 204/197

[51] Int. Cl.[2] ..... D21F 3/10

[58] Field of Search ..... 162/199, 272, 369, 371, 162/372; 204/148, 197; 29/132

[56] References Cited

UNITED STATES PATENTS

| | | | |
|---|---|---|---|
| 3,108,055 | 10/1963 | Grant | 204/197 X |
| 3,141,817 | 7/1964 | Collins et al. | 162/372 |
| 3,171,776 | 3/1965 | Hart et al. | 162/369 |
| 3,847,763 | 11/1974 | Svensson et al. | 204/148 |

*Primary Examiner*—S. Leon Bashore
*Assistant Examiner*—Richard V. Fisher
*Attorney, Agent, or Firm*—W. Allen Marcontell; Richard L. Schmalz

[57] ABSTRACT

Galvanic electrodeposition of copper onto a cast iron vacuum box from a rubber covered brass couch shell carrying a non-conductive papermakers forming wire may be prevented by electrically connecting the brass couch shell with a sacrificial anode of more noble metal than brass by means of a conductive metal shoe pivotally secured to but electrically insulated from said vacuum box so as to run in conductive contact with the inside surface of said shell.

8 Claims, 2 Drawing Figures

GALVANIC PROTECTION OF A COUCH ROLL

BACKGROUND OF THE INVENTION

1. Field Of The Invention

The present invention relates to the art of continuous papermaking by deposit of a fibrous slurry on a traveling foraminous screen. More specifically, the present invention relates to the protection of a foraminous screen carrying couch roll from galvanic deterioration.

2. Description Of The Prior Art

The historic process of manufacturing a continuous web of paper is by deposit of an aquerous slurry of wood fiber from a headbox vessel onto an endless loop of fine mesh bronze screen. The screen is generally threaded between a breast roll under the headbox and a couch or suction roll. As the screen is driven around the closed course, a portion of the water constituency of the slurry drains through the screen leaving a consolidated fibrous mat on the screen.

The couch roll about which the screen turns at the dry end of the drainage course comprises a rotating, perforated, cylindrical shell within which is mounted a stationary vacuum box. Relative to the interior periphery circle of the shell, the vacuum box interior has a sealed communication over an arcuate portion of the circle. The partial vacuum drawn within the vacuum box therefore acts through perforations in the shell and screen traveling over the sealed arc against the paper mat to draw additional water therefrom before transfer into the papermachine wet press section.

Typical couch rolls are described in U.S. Pat. Nos. 1,799,775 to E. E. Berry, 2,714,342 to E. D. Beachler and 3,171,776 to R. H. Hart et al. Representative sizes are 36 inches in diameter and 180 inches in length. Vacuum box construction is of cast iron and couch shell construction is of brass. Consequently, these rolls are generally very heavy and expensive. In addition, they are driven at high rates of speed requiring efficient anti-friction bearings between the vacuum box, the shell and the mounting pedestal.

The usual bearing arrangment for these rolls has the front extension of the vacuum box supported against rotation at the outer end on a hollow sectional pedestal which is provided with a suitable conduit between the vacuum box interior and a vacuum source. At the rear end of the suction box, it is provided with a stub shaft or journal for mounting in an anti-friction bearing assembly which, in turn, is frictionally fitted with a hollow journal depending from an adjacent head of the shell. The hollow journal of the head forms a housing for the bearing assembly and is designed to be an integral part of the head assembly so as to reduce the number of parts and machining operations.

The seal between the vacuum box and the perforated shell interior surface is by means of phenolic impregnated seal strips assisted by flooding the interior shell surface with a pumped supply of "white water" which is that liquid drawn directly from the paper mat. Such white water ranges in acidity from 4 to 6 pH and therefore constitutes an excellent electrolyte.

Notwithstanding the acidity of white water which floods all the structural surfaces within the couch interior, no difficulty has been experienced by paper makers of the past due to galvanic action between the shell and the vacuum box. Logically, this would not be anticipated since an electric short or contact through the bearings between the vacuum box and the shell would be expected. Although these bearings are efficiently lubricated, it is difficult to envision a lubrication film of such effectiveness as to maintain a galvanic action supporting EMF differential between the vacuum box and the shell.

Retrospectively, however, it may be rationalized that in past years when bronze wires were used to form the paper mat, an electrical continuity existed between the brass couch shell, the bronze wire and a stainless steel headbox to ground potential.

Consequently, when the more recent innovation of non-conductive plastic wires in lieu of bronze wires was introduced, wastage of the stainless steel headbox by galvanic action resulted. This circumstance was averted in some situations by coating the couch shell exterior with a non-conductive rubber or polymer plastic.

Now, however, it has been discovered that a rubber covered couch roll operated in combination with a non-conductive wire supports galvanic action between the shell and the vacuum box with the result that copper from the brass shell plates upon the vacuum box.

It is therefore an object of this invention to teach the construction of apparatus which prevents the wastage of a couch shell by electrolysis.

It is another object of this invention to teach the construction of apparatus which prevents the dimensional growth of the vacuum box by electroplating.

SUMMARY OF THE INVENTION

These and other objects of the present invention are achieved by mounting an electrical conduit brush on the stationary vacuum box so as to maintain electrical contact with the interior surface of the rotating brass couch shell. Electrically connected to the brush is an ingot of sacrificial anode metal selected from the electromotive series as a more noble material than brass.

Both, the sacrificial anode ingot and the brush structure are electrically insulated from the vacuum box, per se.

DESCRIPTION OF THE PREFERRED EMBODIMENT

Figure 1:
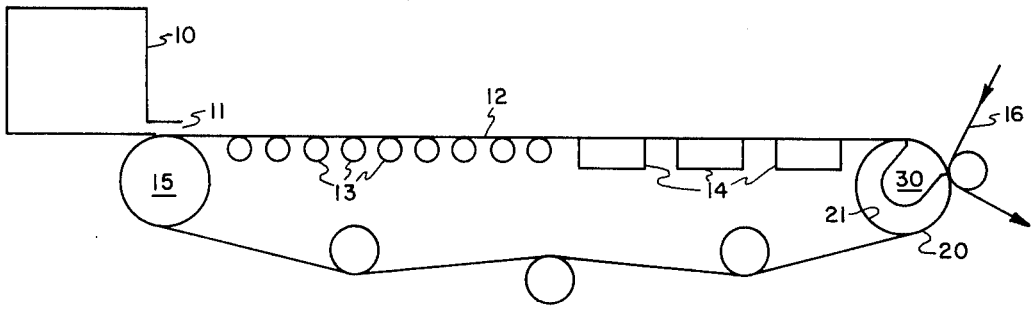
FIG. 1 PRIOR ART
FIG. 1 is a schematic of a typical fourdrinier papermachine.

For purposes of orientation, FIG. 1 schematically illustrates the wet or forming section of a papermachine wherein a dilute, aqueous slurry of wood pulp is flowed from a headbox 10 vessel through a slice 11 opening at the bottom thereof onto a traveling fourdrinier screen 12 carried along a flat, table portion of the closed screen course by a series of table rolls 13 or foils (not shown) and suction boxes 14.

Delineating the table length from wet to dry end, respectively, is the breast roll 15 and the couch roll 20. Following passage over the couch roll, the consolidated paper web is transferred to a porous fabric belt characterized as a felt 16 for delivery through one or more roll nips which mechanically express additional water from the web.

The couch roll 20 to which the present invention is directed, generally comprises a rotating, perforated shell 21 and a stationary vacuum box 30.

Figure 2:
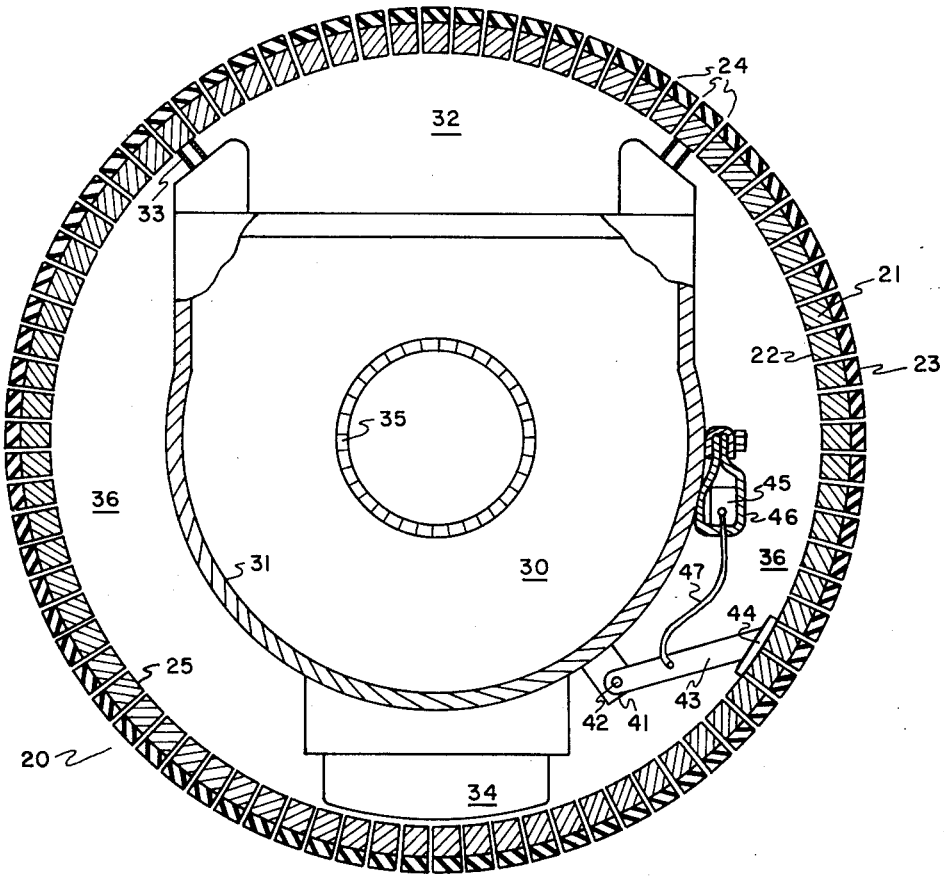
FIG. 2 is a sectional view of a typical fourdrinier couch roll equipped with an embodiment of the present invention.

Relative to FIG. 2, the rotating shell 21 is shown as comprising a brass, cylindrical base 22 coated on the exterior periphery thereof with rubber or other electrical insultation material 23. Projecting through both, the base 22 and the coating 23 are shell perforations 24.

The stationary vacuum box 30 comprises a cast iron drum 31 which is open at the top to an area 32 confined by sealing strips 33. At the exterior bottom on the drive side of the drum 31 is provided a stabilizing shoe 34 used for assembly pruposes only.

At least one axial end of the drum 31 exterior communicates with a vacuum source conduit 35.

As the paper web on the screen 12 is carried over the couch roll 20 between the sealing strips 33, the shell performations 24 permit communication between the web and the partially evacuated volume 32 which draws white water from the web into the drum 31.

Although the dominance of white water drawn within the couch roll 20 is confined to the interior of the drum 31 where it may be conveniently pumped away, a certain portion is sprayed upon the interior wall surface 25 of the shell 21 to cleanse the perforations 24 and assist the maintenance of a seal with the strips 33.

Consequently, the exterior surfaces of the vacuum box 30 and the interior surface 25 of the shell 21 are coated with white water. However, it would be highly unusual for a flooded continuity of white water to exist in the annular space 36 between the respective surfaces.

Within the annular space 36, a nylon or other suitable non-conductive material bearing block 41 is secured to the drum 31. Journaled in the bearing block 41 is a pivot axis 42 for a copper brush carrier 43 and contact shoe 44.

The sacrificial anode ingot 45 such as magnesium is encapsulated within a gas permeable, rubber or plastic, non-conductive pouch 46 and also secured to the drum 31 at a convenient location on the drum 31.

Electrical conduit 47 is connected to complete the continuity between the ingot 45 and the shell surface 25.

As described, the present invention has proven successful in meeting all expectations and objectives under commercial operating conditions. In this regard, four thousand operating hours on a 350 ton per day paperboard machine sacrifically consumed approximately 0.13 pounds of magnesium in a white water electrolyte ranging in acidity from 4.0 to 5.0 pH without further loss of couch shell metal.

Having fully described my invention, I claim:

1. A papermachine couch roll comprising:

A. Perforated cylinder couch shell means having a metal interior cylindrical surface mounted for rotation about a cylindrical axis;

B. Stationary vacuum box means disposed internally of said shell means for sealing a partial vacuum applied to an arcuate portion of said interior cylindrical surface of said shell means;

C. Electrically conductive brush means secured to said vacuum box means by electrically non-conductive mounting means, said brush means being disposed for maintaining electrical contact with said interior surface during rotation of said shell means; and, D. Sacrificial anode means comprising a more noble metal in the electromotive series than the interior surface metal of said shell means, said anode means being electrically connected with said brush means.

2. An apparatus as described by claim 1 wherein said couch shell interior surface metal is brass and said sacrificial anode is of magnesium.

3. An apparatus as described by claim 1 wherein an exterior surface of said couch shell is provided with an electrically non-conductive coating.

4. An apparatus as described by claim 1 wherein said sacrificial anode means is an ingot of said more noble metal encapsulated within an electrically non-conductive pouch means secured to said vacuum box means.

5. In combination with a papermachine having a ferrous metal headbox, an electrically non-conductive fourdrinier wire and a couch roll, said couch roll comprising a brass couch shell having a metallically exposed interior surface periphery rotatably mounted about a stationary ferrous metal vacuum box, the improvement comprising:

A. An electrically conductive brush means secured to said vacuum box by electrically non-conductive mounting means, said brush means being disposed for maintaining electrical contact with said interior shell surface during rotation thereof; and B. Sacrificial anode means comprising a more noble metal in the electromotive series than that of said brass shell, said anode means being electrically connected with said brush means.

6. The combination of claim 5 wherein said sacrificial anode means is an ingot of magnesium.

7. The combination of claim 6 wherein said ingot is encapsulated within an electrically non-conductive pouch means secured to said vacuum box.

8. A method of preventing electrolytic deterioration of the interior surface of a rotating, metallic, papermachine couch shell having a stationary vacuum box means disposed internally of said shell, said method comprising the steps of;

A. Providing an electrically conductive contact brush means having a brush contact end and an other end;

B. Securing said other end to said vacuum box means;

C. Electrically insulating said other end from said vacuum box means;

D. Positioning said brush contact end in pressing, relatively movable electrical contact with said metallic interior surface of said couch shell; and E. Electrically connecting with said brush means a sacrificial anode of metal more noble in the electromotive series than the metal of said shell.

* * * * *